US006185876B1

(12) United States Patent
Kummerfeld et al.

(10) Patent No.: US 6,185,876 B1
(45) Date of Patent: Feb. 13, 2001

(54) INSTALLATION DUCT

(75) Inventors: Ryszard Kummerfeld, Travemünde; Klaus Pete Kricheldorff, Lübeck, both of (DE)

(73) Assignee: Dräger Medizintechnik GmbH, Lubeck (DE)

( * ) Notice: Under 35 U.S.C. 154(b), the term of this patent shall be extended for 0 days.

(21) Appl. No.: 09/255,625

(22) Filed: Feb. 22, 1999

(30) Foreign Application Priority Data

Oct. 17, 1998 (DE) ..... 198 47 979

(51) Int. Cl.[7] ..... A47F 10/00

(52) U.S. Cl. ..... 52/36.1; 52/220.1; 52/36.5

(58) Field of Search ..... 52/36.1, 220.1, 52/28, 36.5, 220.8; 312/209

*Primary Examiner*—Carl D. Friedman
*Assistant Examiner*—Kevin McDermott
(74) *Attorney, Agent, or Firm*—McGlew and Tuttle, P.C.

(57) ABSTRACT

An installation duct for accommodating at least gas outlet couplings shall be improved such that the gas supply lines leading to the gas outlet couplings can be laid and connected in a simple manner. This is accomplished with the features of a connection plate (3), on which the gas outlet couplings (4, 5) are fastened, with a middle part (6) that can be placed on the connection plate (3), and with a cover plate (7), which is fastened to end parts (21, 22) of the side walls (13, 14) of the installation duct (1) pointing away from the connection plate (3).

19 Claims, 4 Drawing Sheets

1

INSTALLATION DUCT

FIELD OF THE INVENTION

The present invention pertains to an installation duct for receiving at least gas outlet couplings.

BACKGROUND OF THE INVENTION

Installation ducts of this type are used to provide compressed gases and electricity in different areas of a building and are arranged, in general, on the walls of the building. Compressed gases are needed, e.g., in rooms used for medical purposes for therapeutic devices.

An installation duct, through which electric and pneumatic supply lines are led to the outlets located at cover plates of the installation duct, has been known from DE 39 37 518 A1. The cover plates are designed here such that they can be screwed to the side walls of the installation duct, so that a common duct is enclosed by the cover plates and the side walls. Similar installation ducts are also used for fastening to building walls.

The drawback of the prior-art installation duct is that the gas supply lines leading to the pneumatic connections, hereinafter called gas outlet couplings, are accessible only with the cover plate removed and the connection of the gas supply lines to the connecting branch of the gas outlet couplings is hindered by the side walls of the installation duct. Since the position of the gas supply lines within the installation duct changes due to the removal of the cover plate from the side walls or the mounting of the cover plate on the side walls, a leakage test must be performed with the cover plate removed and with the cover plate mounted alike. Should the gas connection be leakproof with the cover plate mounted but leaky with the cover plate mounted, it is not possible to analyze the causes from the outside. In addition, only flexible gas supply lines, but no rigid pipelines can be used in the prior-art installation duct.

SUMMARY AND OBJECTS OF THE INVENTION

The primary object of the present invention is to improve an installation duct such that the gas supply lines leading to the gas outlet couplings can be laid in a simple manner and that their position cannot change thereafter.

According to the invention, an installation duct is provided for receiving at least gas outlet couplings. A rail-like connection plate is disposable on a mounting surface. Gas outlet couplings are fastened to the connection plate. A middle part, disposable on the connection plate, has an upper side wall, a lower side wall and a support plate, which connects the side walls in an H-shaped pattern and is located between the said side walls. Openings in the support plate in the area of the gas outlet couplings are dimensioned such that the gas outlet couplings can be led through the openings. A cover plate is fastened to end parts of the side walls pointing opposite the connection plate. The cover plate has passage openings for the gas outlet couplings.

According to another aspect of the invention, the installation duct with rail-like connection plate, middle part and cover is installed and used.

The advantage of the present invention is essentially that a rail-like connection plate, used as a fastening surface for the gas outlet couplings, is first fastened to the wall surface carrying the installation duct, so that the gas outlet couplings are fixed on the wall surface and can be connected to the gas supply lines specifically for the particular types of gas. The gas supply lines may be designed as copper pipes. Since the gas outlet couplings are seated elevated on the connection plate, the connections to the corresponding gas supply lines can be performed without special tools because the connecting branches of the gas outlet couplings are accessible on all sides. A leakage test of the gas-carrying supply lines and of the gas outlet couplings is subsequently possible. Possible leakage points can be localized in a simple manner because of free accessibility on all sides.

In a second step, a middle part of the installation duct is placed on the connection plate and is screwed thereto. The middle part comprises two side walls, which are arranged in parallel to one another and are connected to one another via a support plate in an H-shaped pattern. The middle part is designed as a one-piece extruded section. The support plate has openings, through which the gas outlet couplings can be led during the connection of the middle part to the connection plate. A cover plate is then placed on the end parts of the side walls facing away from the connection plate, the side walls being provided with passage openings at the level of the gas outlet couplings. Gas outlet plugs can thus be introduced into the gas outlet couplings from the outside.

The middle part is advantageously designed as a part that can be inserted into the connection plate. To achieve this, the end area of the upper side wall is provided with individual legs bent off at right angles in the downward direction, which can be inserted into a groove located between the connection plate and the mounting surface.

The connection plate is advantageously provided with a projection, on which the gas outlet couplings are mounted. A free space, by which the connection of the gas supply lines to the connecting branches is substantially simplified, is thus created between the mounting surface and the connecting branches of the gas outlet couplings.

The support plate is preferably fastened between the side walls such that it covers the projection of the connection plate when the middle part is placed on the connection plate. Two supply ducts are thus created within the installation duct, namely, a first duct between the projection, the connection plate, the support plate and the side walls, through which gas supply lines can be led, and a second duct for electric lines is defined by the cover plate, the support plate and the side walls.

The end parts of the side walls are advantageously designed to receive additional connection plates. For example, snap connections, with which the connection plates are fixed to the end parts, are suitable fastening elements for the connection plates. Additional connection plates may be provided with electric outlets. An installation duct thus offers both pneumatic and electric energy.

The present invention is not limited to the exemplary embodiment shown, but a plurality of connection plates with gas outlet couplings may also be present over the course of the installation duct, and the cover plates may also be provided, outside the gas outlet couplings, with connections for data transmission, so that connection to a centrally arranged energy supply unit and monitoring unit is possible. A modular system design of the installation duct according to the present invention can be obtained due to the different design and equipment of the cover plates.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
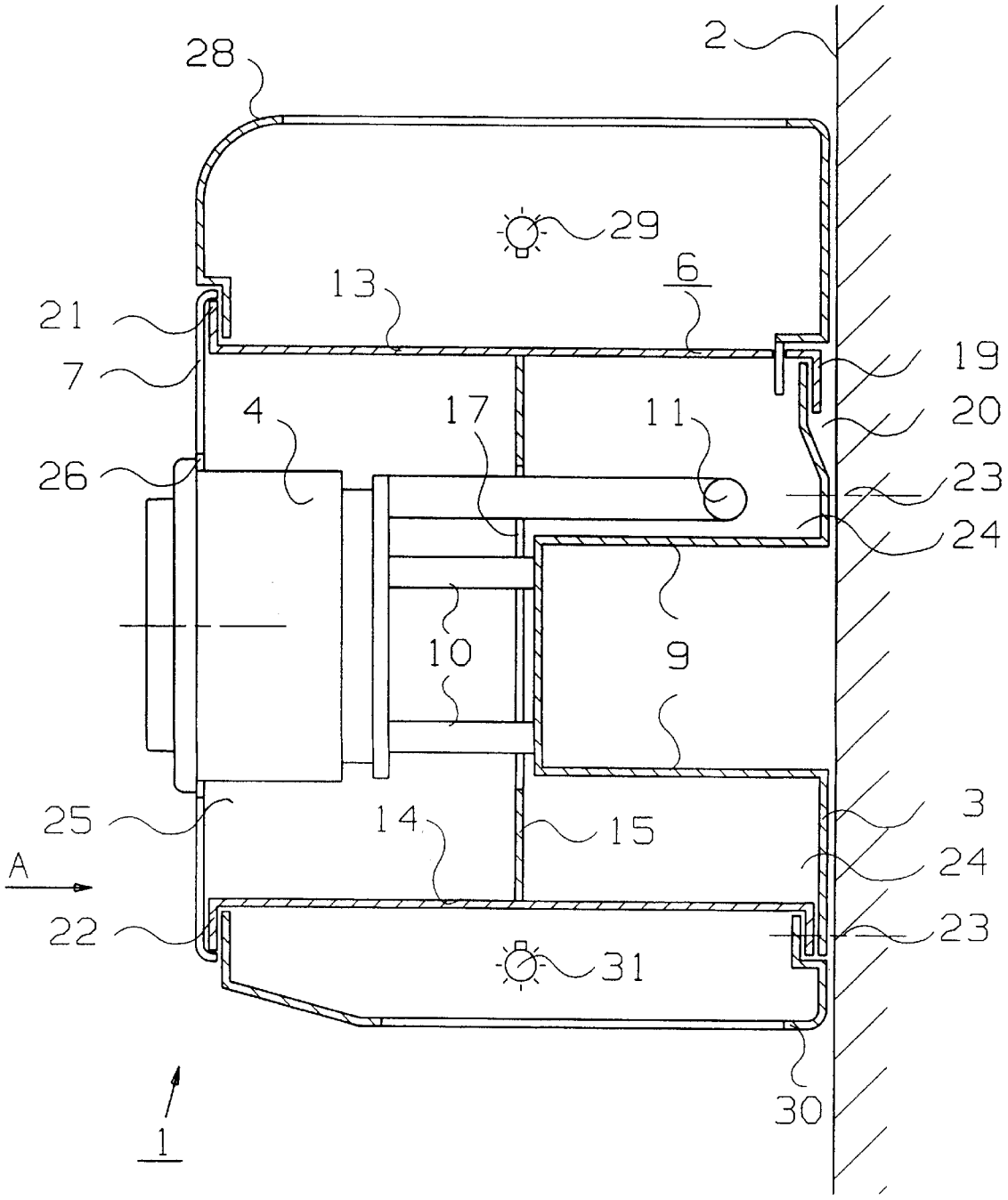
FIG. 1 is a longitudinal sectional view of an installation duct.

Referring to the drawings in particular, FIG. 1 schematically shows a longitudinal section through an installation duct, which comprises a connection plate 3 fastened to a mounting surface 2 with gas outlet couplings 4, 5, a middle part 6 and cover plates 7, 8. Only the gas outlet coupling 4 and the cover plate 7 are illustrated in FIG. 1. The connection plate 3 is provided with a U-shaped projection 9, to which the gas outlet couplings 4, 5 are fastened by means of bolts 10. The gas outlet couplings 4, 5 have connecting branches 11, 12 for gas type-specific gas supply lines, not shown in FIG. 1. The middle part 6 comprises an upper side wall 13 and a lower side wall 14, which are connected to one another by means of a support plate 15. The middle part 6 is designed as a one-piece extruded section. In the area of the gas outlet couplings 4, 5, the support plate 15 has openings 17, 18, which are dimensioned such that the gas outlet couplings 4, 5 can be led through them. To fasten the middle part 6 to the connection plate 3, legs 19, which are bent off downward at right angles and can be inserted into a groove located between the connection plate 3 and the mounting surface 2, are provided in the end area of the upper side wall 13. The end parts 21, 22 of the side walls 13, 14 pointing away from the connection plate 3 are designed to fasten the cover plates 7, 8, e.g., by means of snap connections, not shown in FIG. 1. Together with the middle part 6, the connection plate 3 is fastened to the mounting surface 2 by means of individual studs 23, which are indicated only schematically in FIG. 1.

The side walls 13, 14, the connection plate 3 with the projection 9, and the support plate 15 define a first duct 24, which is used to accommodate gas supply lines, not shown in the figure. A second duct 25, defined by the cover plates 7, 8, the side walls 13, 14, as well as the support plate 15 is provided for electric lines, likewise not shown in FIG. 1. The gas outlet couplings 4, 5 are led to the outside via passage openings 26, 27 in the cover plate 7.

The installation duct 1 is additionally also provided with lighting means. Thus, a transparent cover 28 for a ceiling light source 29 is provided on the upper side wall 13, and a likewise transparent cover 30 for a reading light source 31 is provided on the lower side wall.

Figure 2:
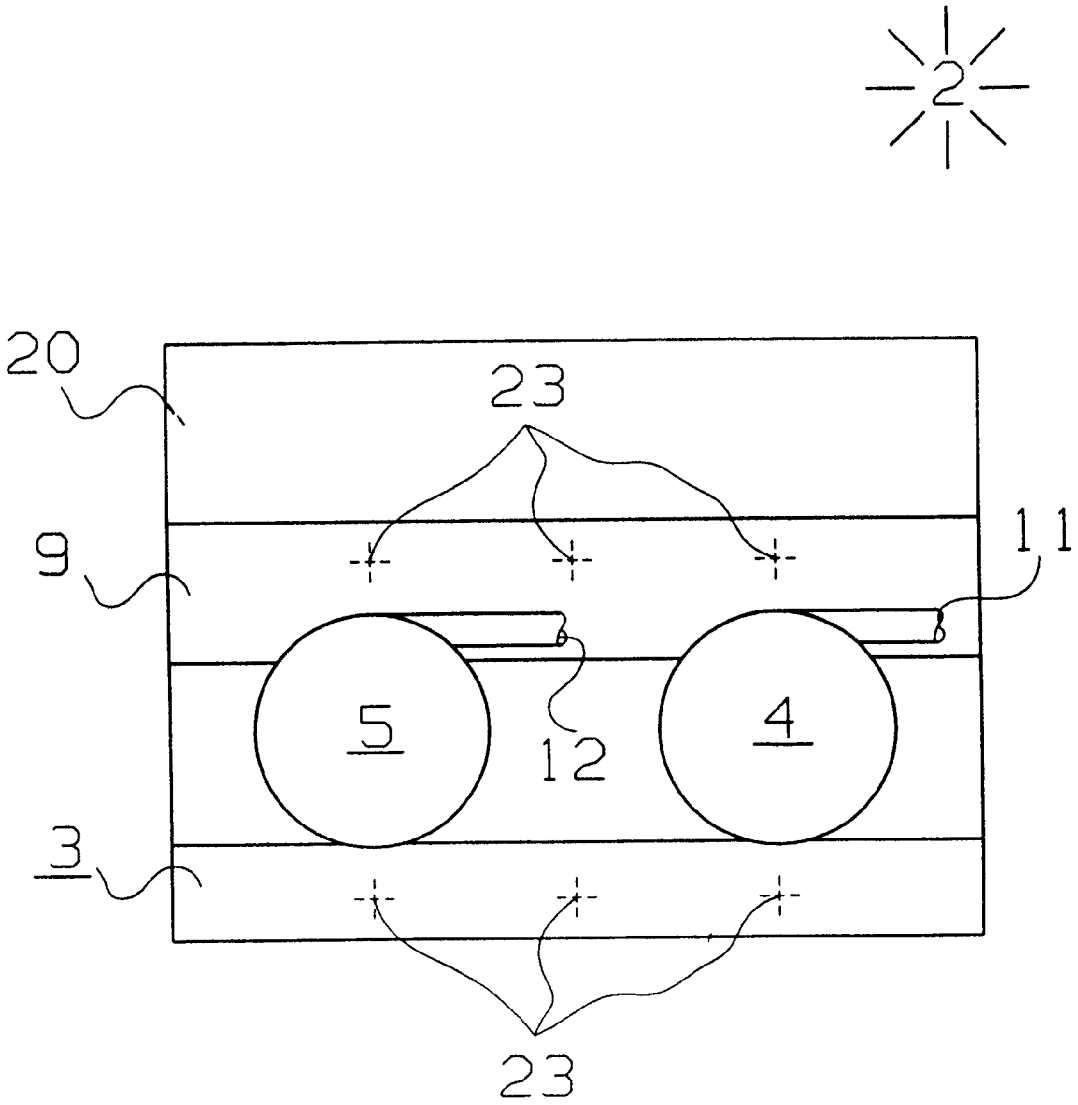
FIG. 2 is a top view of a connection plate provided with gas outlet couplings in the direction of view A according to FIG. 1.

FIG. 2 shows a top view of the connection plate 3 provided with the gas outlet couplings 4, 5 in the direction of view A according to FIG. 1. Identical components are designated with the same reference numbers as in FIG. 1. The groove 20, which is schematically shown in FIG. 2, is covered by the connection plate 3.

Figure 3:
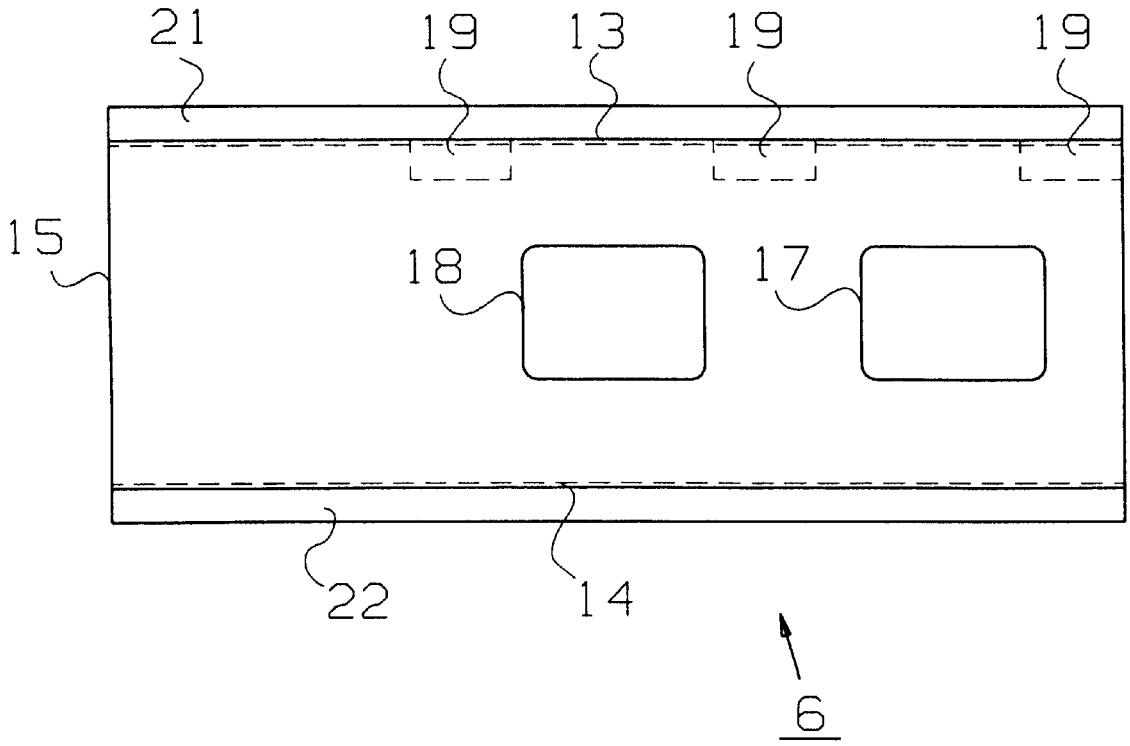
FIG. 3 is a top view of a middle part in the direction of view A according to FIG. 1.

FIG. 3 shows a top view of the middle part 6 in the direction of view A according to FIG. 1, whose legs 19 can be inserted into the groove 20 (FIG. 1) located between the mounting surface 2 and the connection plate 3.

Figure 4:
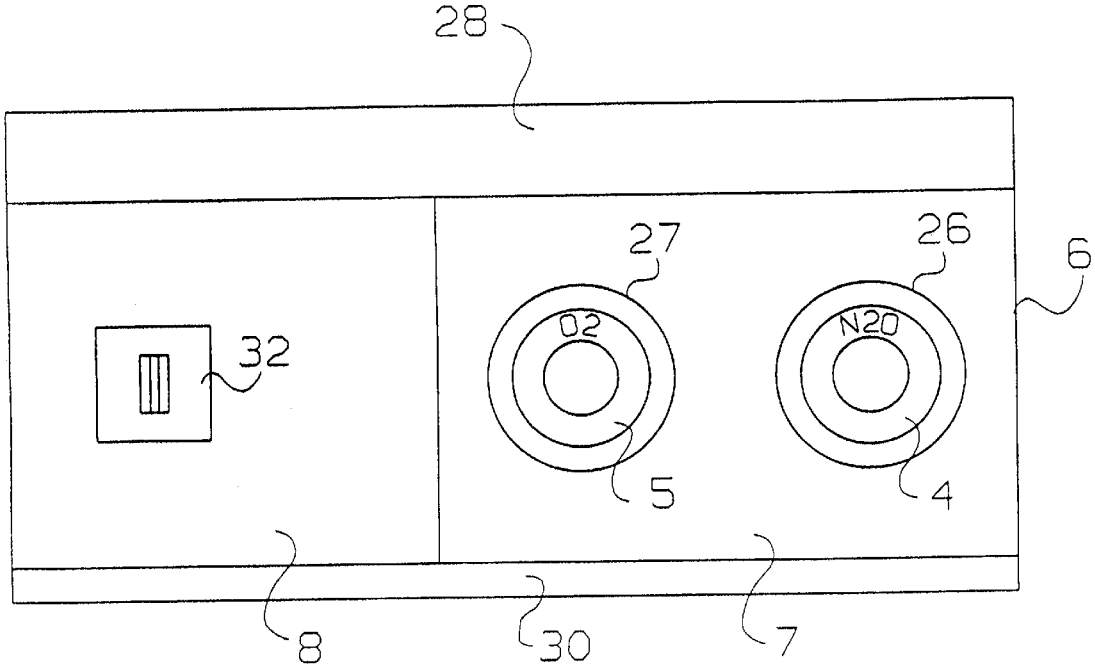
FIG. 4 is a top view of a middle part in the direction of view A according to FIG. 1.

FIG. 4 shows the installation duct 1 in the direction of view A according to FIG. 1. A cover plate 8, which is provided with an electric outlet 32, is located next to the cover plate 7 located at the gas outlet couplings 4, 5. Thus, both electricity and pneumatic energy can be offered with the installation duct 1 according to the present invention.

The mounting of the installation duct 1 is performed in the following steps.

The connection plate 3 with the gas outlet couplings 4, 5 is first fastened to the mounting surface 2 by means of the studs 23 located along the groove 20 (FIG. 2). The gas supply lines, not shown in the figures, are then connected to the connecting branches 11, 12 and a test for gas leaks is performed. Possible leaks can be localized and eliminated in a simple manner because of the free accessibility from all sides. The middle part 6 is then connected to the connection plate 3 by inserting the legs 19 into the groove 20, so that the gas outlet couplings 4, 5 are led through the openings 17, 18 located in the support plate 15. The fastening of the middle part 6 together with the connection plate 3 is performed by means of the studs 23 (FIG. 1) located in the area of the lower side wall 14. The cover plates 7, 8 are then placed on the end parts 21, 22 of the side walls 13, 14 (FIG. 1 and FIG. 4) and the covers 28, 30 are finally put in place (FIG. 1). Since prefabricated assembly units can be used during the mounting, this can be performed simply and at a low cost.

While specific a embodiment of the invention has been shown and described in detail to illustrate the application of the principles of the invention, it will be understood that the invention may be embodied otherwise without departing from such principles.

What is claimed is:

1. An installation duct for receiving at least gas outlet couplings at a mounting surface, the installation duct comprising:

a rail-like connection plate disposable on the mounting surface the gas outlet couplings being fastened to said connection plate;

a middle part disposable on said connection plate, said middle part having an upper side wall, a lower side wall and a support plate, which connects said side walls in an H-shaped pattern and is located between said side walls, said support plate having openings in an area of the gas outlet couplings, the openings being dimensioned such that the gas outlet couplings can be led through said openings, said side walls having end parts; and a cover plate fastened to said end parts of said side walls opposite said connection plate, said cover plate having passage openings for the gas outlet couplings.

2. The installation duct in accordance with claim 1, wherein said middle part has at least one portion insertable into said connection plate.

3. The installation duct in accordance with claim 2, wherein said upper side wall has an end area provided with legs and said connection plate has a groove, which extends in an area of said upper side wall and into which said legs can be inserted.

4. The installation duct in accordance with claim 1, wherein said connection plate has a projection, on which the gas outlet couplings are mounted.

5. The installation duct in accordance with claim 4, wherein said support plate is fastened between said side walls such that it covers said projection with said middle part placed on said connection plate.

6. The installation duct in accordance with claim 4, wherein a duct for accommodating gas supply lines is formed by said projection, said connection plate, said support plate and said side walls.

7. The installation duct in accordance with claim 1, wherein a duct for accommodating electric lines is formed by said cover plate, said support plate and said side walls.

8. The installation duct in accordance with claim 1, wherein said end parts of said side walls receive first and second additional connection plates respectively.

9. The installation duct in accordance with claim 8, wherein at least one of said additional connection plates is provided with an electric outlet.

10. The installation duct in accordance with claim 1, further comprising a ceiling light source with a corresponding cover provided in an area of said upper side wall.

11. The installation duct in accordance with claim 1, further comprising a reading light source with a cover covering said reading light source provided in the area of the said lower side wall.

12. A method of use of gas outlet couplings at a mounting surface, the method comprising the steps of:

providing an installation duct with a rail-like connection plate, a middle part, said middle part having an upper side wall, a lower side wall and a support plate, which connects said side walls in an H-shaped pattern and is located between said side walls, said support plate having openings for the gas outlet couplings, said side walls having end parts and a cover plate said cover plate having passage openings for the gas outlet couplings;

disposing said connection plate on the mounting surface;

fastening the gas outlet couplings to said connection plate;

disposing said middle part on said connection plate;

dimensioning said openings of said support plate such that the gas outlet couplings can be led through said openings;

leading the gas outlet couplings through said openings; and fastening said cover to said end parts of said side walls opposite said connection plate.

13. The method in accordance with claim 12, further comprising inserting a portion of said middle part into said connection plate.

14. The method in accordance with claim 12, wherein said upper side wall has an end area provided with legs and said connection plate has a groove, which extends in an area of said upper side wall, and further comprising inserting said legs into said groove.

15. The method in accordance with claim 12, wherein said connection plate has a projection, the gas outlet couplings being mounted to the projection.

16. The method in accordance with claim 15, wherein said support plate is fastened between said side walls such that it covers said projection with said middle part placed on said connection plate.

17. The method in accordance with claim 15, wherein a duct for accommodating gas supply lines is formed by said projection, said connection plate, said support plate and said side walls, a second duct for accommodating electric lines is formed by said cover plate, said support plate and said side walls.

18. The method in accordance with claim 15, wherein said end parts of said side walls receive first and second additional connection plates respectively.

19. The method in accordance with claim 12, wherein the installation duct is used to supply energy to devices in a medical treatment room.

* * * * *